US011204214B2

(12) United States Patent
Kirsch

(10) Patent No.: US 11,204,214 B2
(45) Date of Patent: Dec. 21, 2021

(54) PRACTICE MAGAZINE FOR FIREARMS

(71) Applicant: Double-Alpha Academy B.V., Waalwijk (NL)

(72) Inventor: Saul J. Kirsch, Waalwijk (NL)

( * ) Notice: Subject to any disclaimer, the term of this patent is extended or adjusted under 35 U.S.C. 154(b) by 273 days.

(21) Appl. No.: 16/691,283

(22) Filed: Nov. 21, 2019

(65) Prior Publication Data

US 2021/0156639 A1 May 27, 2021

(51) Int. Cl.
*F41A 33/00* (2006.01)
*F41A 9/65* (2006.01)

(52) U.S. Cl.
CPC ..... *F41A 33/00* (2013.01); *F41A 9/65* (2013.01)

(58) Field of Classification Search
CPC ..... F41A 33/00; F41A 33/02; F41A 33/04; F41A 33/06; F41A 9/65
See application file for complete search history.

(56) References Cited

U.S. PATENT DOCUMENTS 9,182,189 B2 11/2015 Seigler
2008/0127538 A1* 6/2008 Barrett ..... F41A 9/62 42/1.02
2018/0128570 A1* 5/2018 Sawicki ..... F41A 9/65

OTHER PUBLICATIONS

M92A1 Deluxe Replica Training Pistol, Inert Products LLC, https://inertproducts.com/inc/sdetail/8631.

* cited by examiner

*Primary Examiner* — Timothy A Musselman
(74) *Attorney, Agent, or Firm* — Whitley Legal Group, P.C.; AnnMarie W. Whitley

(57) ABSTRACT

A practice magazine includes a housing that at least partially houses one or more weights, a rotating or pivoting follower, and a spring for biasing the follower in a first direction that is toward the slide of a firearm when the practice magazine is positioned in the magazine compartment of the firearm. The housing also includes a magazine catch notch and additional features to cooperate with the firearm magazine compartment's geometry. The follower attaches to the housing at a pivot support around which it can rotate, and the housing and follower include a stopper arrangement that limits excessive rotation of the follower. The spring, disposed between the follower and housing, produces tension when the practice magazine is fully inserted into the magazine compartment of the firearm. The weights are disposed in the housing to mimic the weight of loaded ammunition.

20 Claims, 5 Drawing Sheets

PRACTICE MAGAZINE FOR FIREARMS

FIELD OF THE INVENTION

The present invention relates to firearms and more specifically to a novel and useful magazine useful with firearms during practice and training sessions.

BACKGROUND OF THE INVENTION

Integral or removable magazines store and feed ammunition to repeating firearms. The magazine, which is sometimes also referred to as a clip, functions by moving the cartridges stored within it into a position where they may be loaded into the barrel chamber by the action of the firearm. Magazines are available in a variety of shapes and sizes and may hold more than one hundred rounds of ammunition.

Dummy or practice magazines are used for practice and training purposes the world over by sport-shooters, law enforcement, military, and others. They are particularly useful when dry firing to practice firearm techniques such as grip, drawing, sight alignment, trigger control, reloading, malfunctions, and more. When practicing reloading, however, magazines are frequently dropped on the floor. Accordingly, practice magazines are particularly useful as they spare the real magazine the wear and tear and damage that would ordinarily occur over time.

Dummy or practice magazines add an element of safety as well. For example, practice magazines can be clearly identifiable by using a bright color. Because they cannot hold any live ammunition, brightly colored or otherwise visually distinct practice magazines greatly reduce the risk of a trainee accidently introducing a real magazine, which may have live ammunition, to a dry fire practice session.

Importantly, dummy or practice magazines should simulate as closely as possible the feel and experience of handling a real loaded magazine. For example, they should be weighted like a real magazine. Additionally, they should simulate the resistance one feels when seating a loaded magazine into a firearm and locking it in place. Also, when locked in the gun, the dummy magazine ideally is secure rather than loose, and when the magazine-release button is activated and the magazine is ejected, it ejects with some spring tension as a real magazine would eject. Accordingly, to achieve a realistic feel and experience of handling a real loaded magazine there should be tension on the practice magazine when in the firearm.

One way to closely mimic the feel and experience of a firearm loaded with a real magazine is to use a real magazine loaded with dummy rounds of ammunition. Unfortunately, this presents multiple problems including, for example, needing at least 50 dummy rounds to load up three magazines for practice. Using a large number of dummy rounds is time consuming to properly load and unload from the magazines. Additionally, because the dummy rounds are typically real ammunition simply missing primer and powder, there are serious and potentially deadly safety concerns as real ammunition may be accidentally used instead of dummy ammunition.

Currently, there are a few dummy or practice magazines available commercially, but they have drawbacks. Most of the presently available products are simply replica training pistols and magazines rather than viable spring-loaded dummy magazines suitable for fully functioning firearms. Other currently available products are designed to emphasize alternative training aspects. For example, the dummy magazine that is presented in U.S. Pat. No. 9,182,198, is designed specifically to reset a single action trigger on a firearm to simulate the realistic feel of the trigger during firing practice. Unfortunately, like the replica products, it fails to account for the tension needed against the slide in the firearm.

Because it is important to practice firing and reloading a firearm and because it is particularly useful to do so with a realistic yet safe magazine, it would be desirable to provide a practice magazine that is simulates the feel and experience of using a real magazine. Additionally, it would further be desirable to provide a practice magazine that simulates the feel of a real magazine when ejected from and inserted into the firearm. Such a practice magazine would be a notable advance in the firearm and ammunition arts.

BRIEF SUMMARY OF THE INVENTION

In accordance with the present invention a novel and useful practice magazine for use with training firearms and fully functioning firearms having an empty magazine compartment is provided. The practice magazine includes a magazine body housing that houses one or more weights, a rotating or pivoting follower, and a spring for biasing the follower in a first direction. The housing can be one component or broken into multiple attached components, can be made from the same material used for real magazines to mimic the feel of real magazines, and preferably is colored or decorated distinctly to distinguish it from real magazines. The housing in general defines features necessary for cooperating with training firearms and fully functioning firearms such as a magazine catch notch that cooperates with the firearm magazine catch assembly, and a base plate or section that cooperates with the geometry of the firearm magazine compartment. The housing also defines features necessary for cooperating with and securing the follower at least partly within the housing. For example, the housing preferably includes a pivot support around which the follower can rotate and a stopper arrangement to limit excessive rotation of the follower. Additionally, a spring or similar components are situation in the housing such that they cooperate with the follower to provide a resistance force especially when the follower abuts the slide of the firearm, which occurs when the practice magazine is fully inserted into the magazine compartment of the firearm. For example, a compressions spring can be positioned adjacent to the follower such that it biases the follower to rotate in a first direction out the housing. Alternatively, a torsion spring can be positioned around the pivot support and attached to the follower to bias the follower in the same first direction. Positioned within the housing are one or more weights, which are included to mimic the weight of loaded ammunition.

When using the practice magazine with a firearm, it operates much like a real magazine loaded with ammunition due to the weights and the spring-loaded follower. As the magazine is inserted into the firearm, the follower contacts the bottom of the firearm's slide, which then applies resistance or pressure downward on the follower and opposite the resting state of the spring. The resistance simulates the feel of inserting a loaded magazine into a firearm. Once fully inserted, the force on the spring is maintained when the magazine catch notch meets the magazine catch of firearm causing the practice magazine to lock into place. The force then placed on the magazine catch prevents the practice magazine from rattling in the grip of the firearm. Once the practice magazine is locked in place, the firearm feels like a loaded firearm and can be dry fired. After dry firing the firearm and when ready to eject the practice magazine from firearm, the magazine catch can be externally activated so it releases from magazine catch notch of the practice magazine. The practice magazine then ejects from the grip of the firearm with resistance force created by the compressed spring on the follower and the slide of the firearm. Because it ejects due to the force of the spring on the follower and slide, the practice magazine ejects much like a real magazine ejects from a firearm, which therefore creates a more realistic experience for the practicing shooter.

The features and advantages of the present invention will be readily apparent to those skilled in the art upon a reading of the description of the exemplary embodiments, which follows.

For a better understanding of the invention reference is made to the following detailed description of the preferred embodiments of the invention which should be taken in conjunction with the above described drawings.

DETAILED DESCRIPTION OF THE INVENTION

Figure 5:
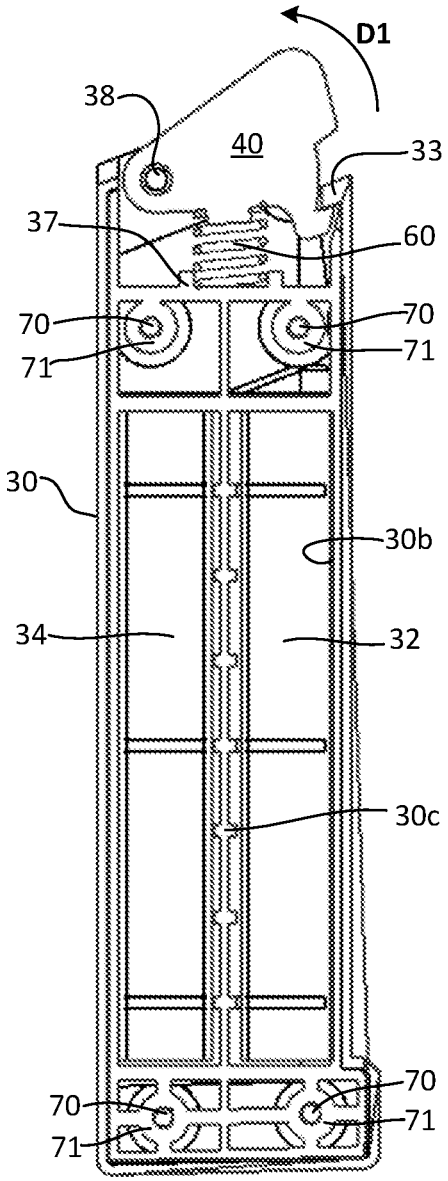
FIG. 5 is a cutaway view of the practice magazine as cut along the line 5-5 shown in FIG. 4.
Figure 6:
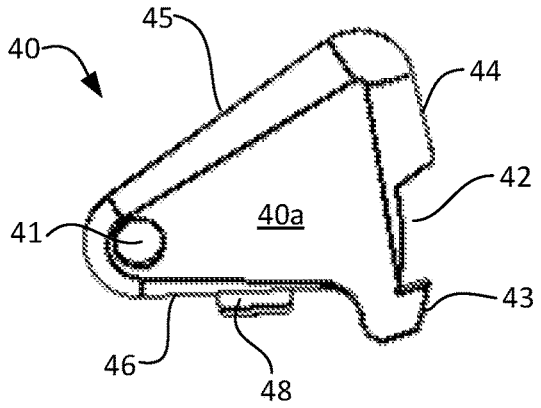
FIG. 6 is a first side view of the follower of the practice magazine of the present invention.
Figure 7:
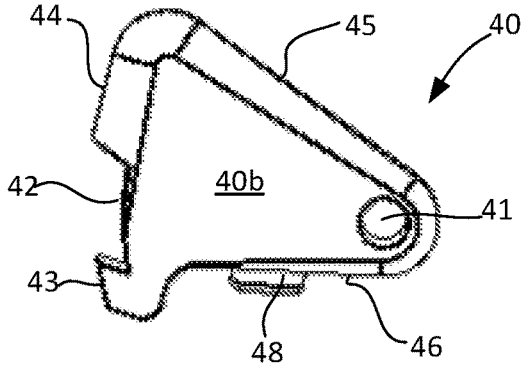
FIG. 7 is a second side view of the follower of the practice magazine of the present invention.
Figure 8:
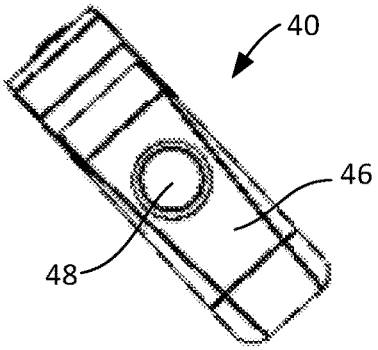
FIG. 8 is a bottom view of the follower of the practice magazine of the present invention.
Figure 10:
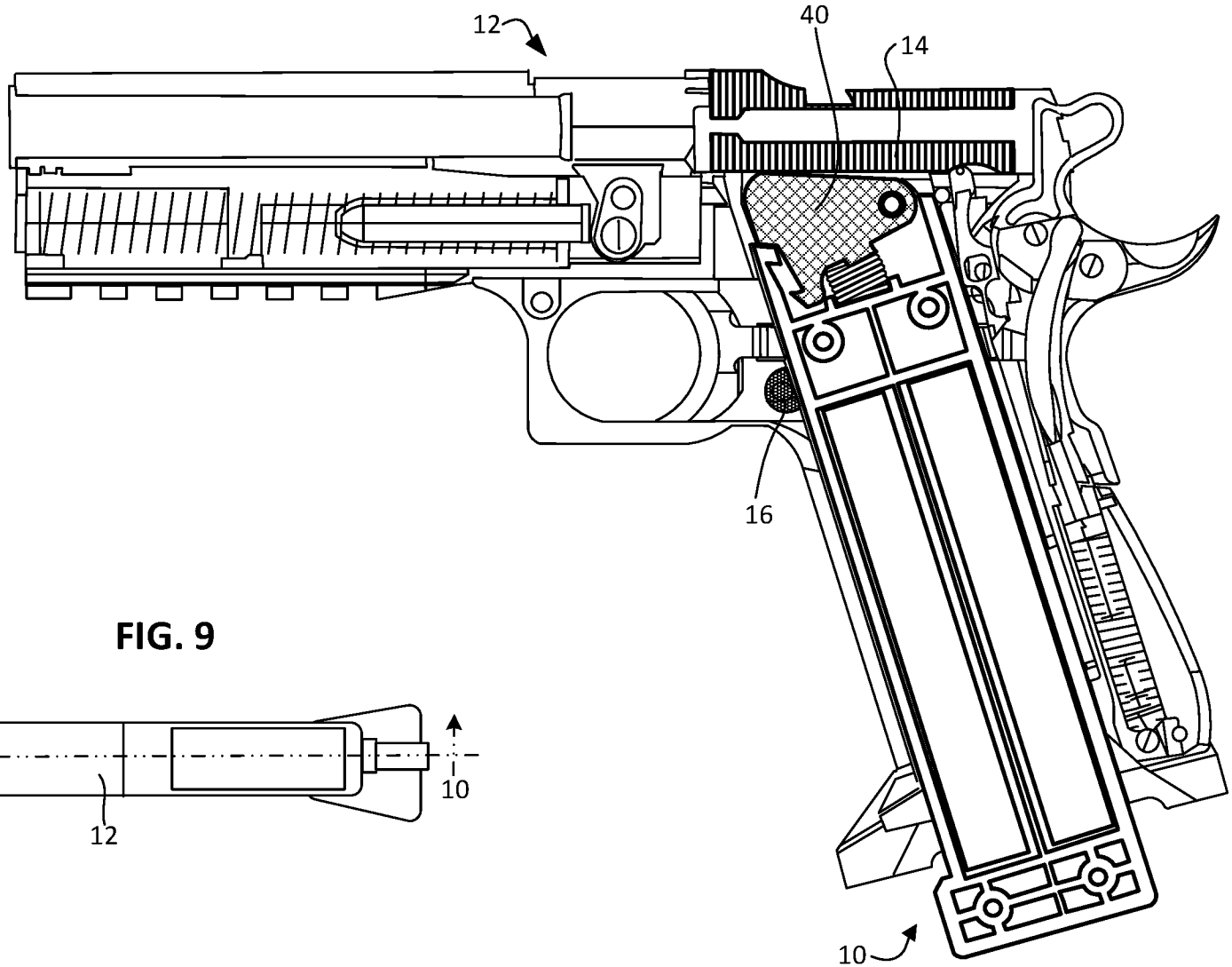
FIG. 10 is a cutaway view of the firearm and practice magazine of the present invention as cut along the lines 10-10 as shown in FIG. 9.
Figure 9:
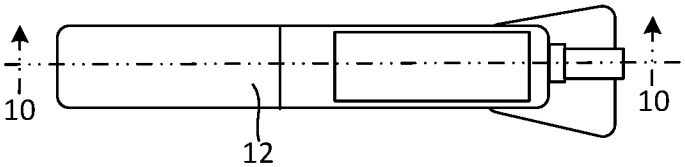
FIG. 9 is a top view of a firearm with the practice magazine of the present invention.

The present invention, as shown in FIGS. 1-10, relates to a novel and useful practice magazine 10 for use with training firearms and fully functioning firearms 12 having an empty magazine compartment. FIGS. 1-5 illustrate the general features of practice magazine 10, and FIGS. 6-8 illustrate the follower 40 of the practice magazine 10. FIGS. 9-10 illustrate how the practice magazine 10 cooperates with a firearm 12, which should be understood to include all types of firearms including rifles and pistols.

As shown in FIGS. 1-5, practice magazine 10 includes a magazine body housing, which is shown in the Figures as cooperating first and second housings 20, 30, that houses one or more weights 50, a spring 60, and a follower 40. First and second housings 20 and 30 are optionally held together with fasteners 70 or adhesive, and the magazine body housing in general defines features necessary for cooperating with training firearms and fully functioning firearms having an empty magazine compartment such as a magazine catch notch 21. The magazine body housing also defines features necessary for cooperating with follower 40 such as a pivot support, which is shown as cooperating pivot supports 28, 38, and a stopper for follower 40, which is shown as cooperating stoppers 23, 33. While two cooperating first and second housings 20, 30 are illustrated and described, they may be integrated as one component or further divided into multiple additional components that are held together with fasteners, adhesive, or the like, as will be understood by those skilled in the art. Additionally, the features of first and second housings 20, 30 that are mirror images between first and second housings 20, 30 may be present on only one of first and second housings 20, 30 without changing the scope of the invention, especially where manufacturing and design considerations suggest economy, as will be understood by those skilled in the art.

Magazine body housing, including first and second housings 20, 30, preferably is made from a rigid material like plastic, steel, or the like. More preferably, it is made from fiber filled plastic and is colored or decorated distinctly to distinguish it from real magazines. As shown in the Figures, first and second housings 20, 30 each have an outer surface 20*a*, 30*a* and an inner surface 20*b*, 30*b*. Additionally, first and second housings 20, 30 each have a first end 20*d*, 30*d* that includes a recess or gap so that when assembled, the first end of the magazine body housing is partly open and a second end 20*e*, 30*e* that is substantially continuous such that when assembled, the second end of magazine body housing is substantially closed.

First and second housings 20 and 30 optionally and preferably also each include a lower support section 25, 35 at or near second ends 20*e*, 30*d* that are configured such that when assembled magazine body housing has a lower section that cooperates with the general geometry of the firearm magazine cavity. For example, lower support sections 25, 35 are configured to simulate a base pad at the bottom, which can be a detachable part on the base of a magazine useful for dismantling a real magazine. While lower support sections 25, 35 mimic the detachable portion of a real magazine, for the present invention they can be fixedly attached or integral with the rest of magazine housing 20, 30 as long as they fit the contour of the bottom of the firearm and preferably match the look and feel of real magazines. Lower support sections 25, 35 also are wider and preferably a little rounded on the bottom to be more comfortable to handle when using you're the base of one's palm to repeatedly seat the magazine into the gun.

Figure 1:
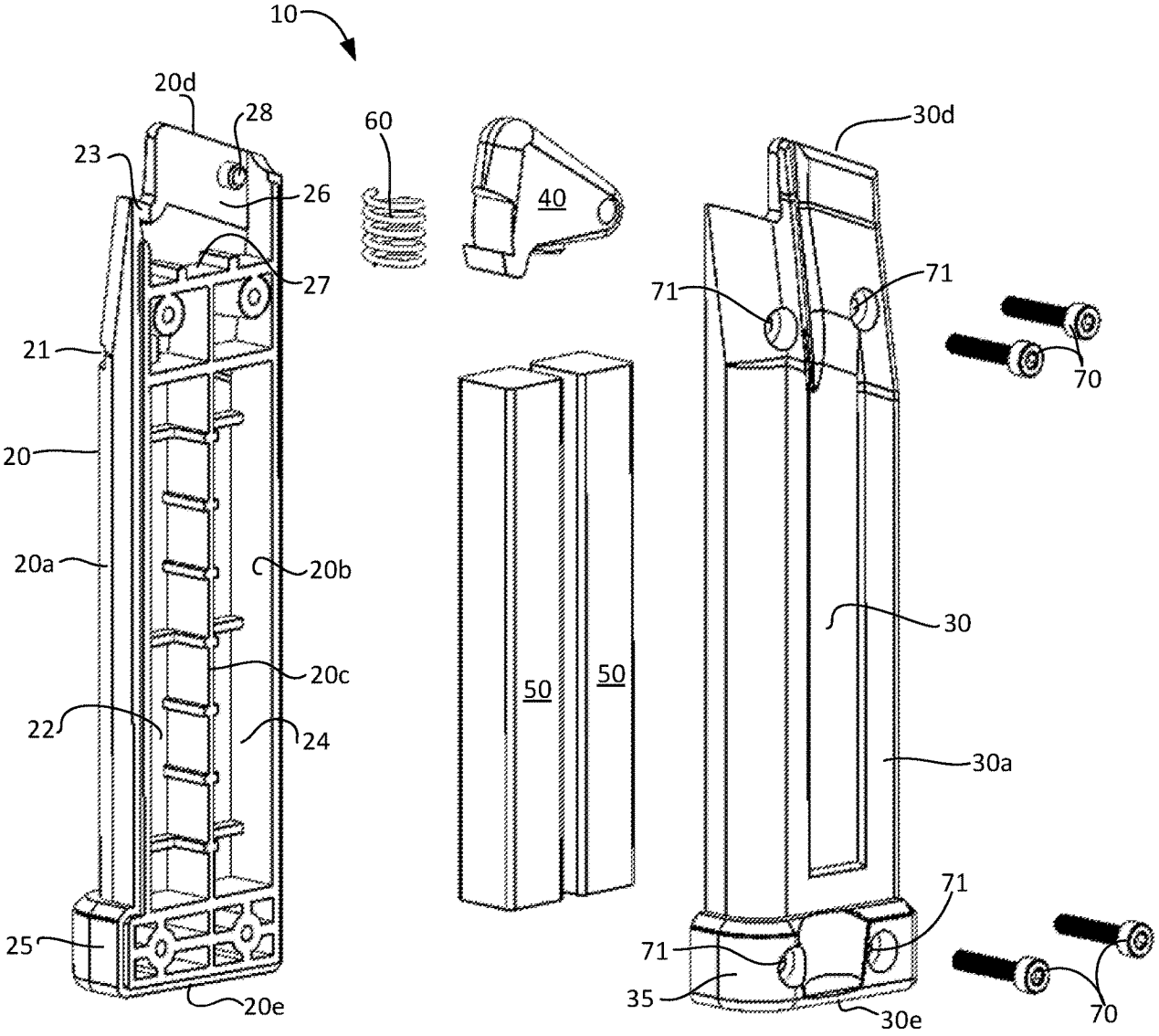
FIG. 1 is an exploded view of the practice magazine of the present invention.
Figure 2:
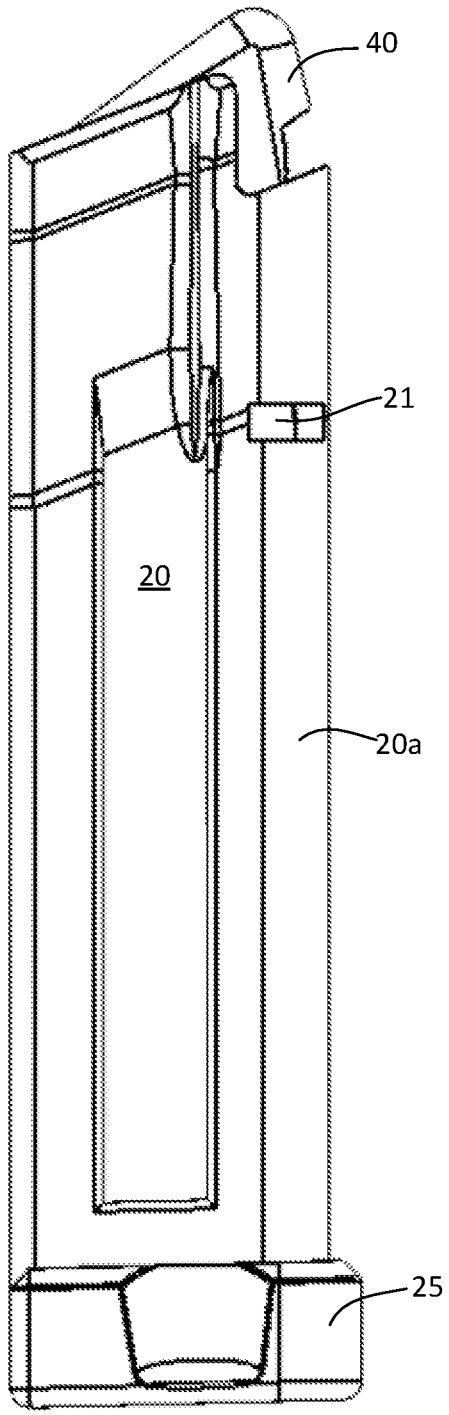
FIG. 2 is a first side view of the practice magazine of the present invention.
Figure 3:
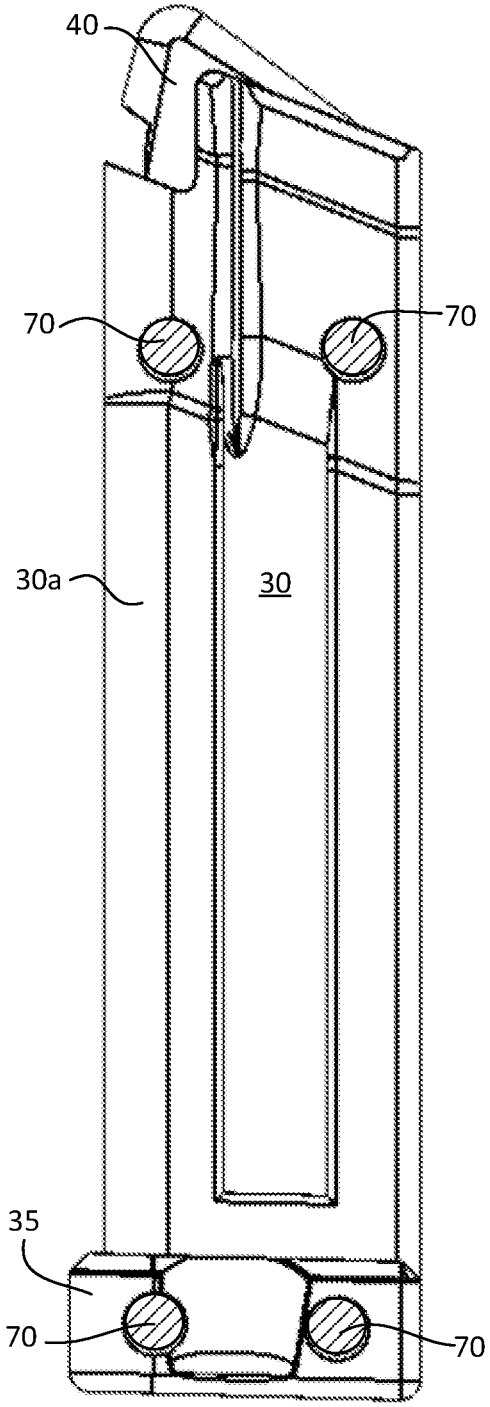
FIG. 3 is a second side view of practice magazine of the present invention.
Figure 4:
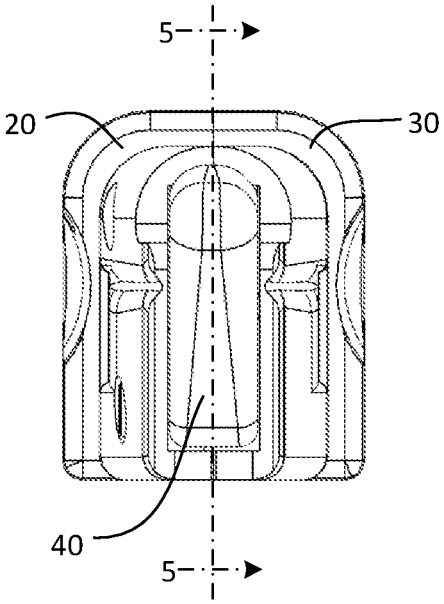
FIG. 4 is a top view of practice magazine of the present invention.

The inner surfaces 20*b*, 30*b* of housings 20, 30 preferably define one or more cavities for accommodating fasteners, weights 50, and additional features such as follower 40. For example, as shown in FIGS. 1 and 5, inner surface 20*b* of first housing 20 defines a follower cavity 26 near first end 20*d* and side by side weight cavities 22, 24 between first end 20*d* and second end 20*e*, which is further separated by an optional spacer 20*c* either attached to first housing 20 or integral with first housing 20 as shown. Similarly, inner surface 30*b* of second housing 30 defines a follower cavity 36 near first end 30*d* and side by side weight cavities 32, 34 between first end 30*d* and second end 30*e*, which are further separated by an optional spacer 30*c* either attached to second housing 30 or integral with second housing 30 as shown.

Also defined by or attached to inner surfaces 20*b*, 30*b* of first and second housings 20, 30 in the area of the follower cavities 26, 36 are cooperating follower supports 28, 38 and cooperating spring supports 27, 37. Follower supports 28, 30 preferably are pins that protrude into follower cavities 26, 36 and form a partial or complete shaft about which follower 40 can rotate when first and second housings 20, 30 are fastened together. Alternatively, any support that assists with orienting and holding the follower while still allowing it to rotate or pivot is acceptable. For example, inner surfaces 20*b*, 30*b* or housings 20, 30 may provide connection points that facilitate rotation and to which follower 40 may directly attach. Spring supports 27, 37 preferably are spacers, ridges, flanges, or other connection structures or assemblies that work together to prevent spring 60 from shifting out of position. As shown in the Figures, spring supports 27, 37 are a plurality of ridges and spacers (not individually labelled).

First and second housings 20, 30 further define follower stoppers 23, 33 positioned at or near first ends 20*d*, 30*d* as shown. Follower stoppers 23, 33 extend into follower cavities 26, 36 and are configured to cooperate with follower 40 and prevent it from unwanted rotation. As shown in the Figures, stoppers 23, 33 are teeth or projections that fit within a notch 42 defined by upper and lower protrusions 44, 43 of follower 40. Alternatively, follower stoppers could be a notch (not shown) formed along housings 20, 30 where the notch cooperates with a projection or tooth (not shown) extending from follower 40. Additionally, other cooperating features can be substituted for a cooperating tooth and notch arrangement, as will be understood by those skilled in the art, as long as the cooperating features prevent follower 40 from pivoting or rotating more than desired.

Side by side weight cavities 22, 24 in first housing 20 and side by side weight cavities 32, 34 in second housing accommodate one or more weights 50. Preferably two weights 50 are secured between first and second housings such that one weight 50 is positioned in weight cavities 22, 32 when first and second housings 20, 30 are attached together and a second weight 50 is positioned in weight cavities 24, 34 when first and second housings 20, 30 are attached together. Alternatively, first and second housings 20, 30 may define fewer or additional weight cavities to accommodate a single weight 50 or to accommodate three or more weights 50. Preferably, weights 50 are made of steel and are positioned such that they mimic the weighting of real ammunition when it is loaded in a real magazine.

First and second housings can attach together with fasteners such as screws 70 that cooperating with threaded receivers 71 integrally formed with or securely attached to housings 20, 30 as shown in the Figures. While screws are shown, other types of fasteners such as snap fit connectors or adhesive may be used as long as they permanently or removably secures housings 20, 30 together. Preferably, adhesive is used to secure housings 20, 30 together.

Defined on the outer surface of first housing 20 is a magazine catch notch 21 that cooperates with the magazine catch 16 of a firearm. Magazine catch notch should be positioned and configured to cooperate with the firearm magazine catch 16 when practice magazine 10 is seated in the firearm as shown in FIG. 10.

FIGS. 5-8 illustrate follower 40, spring 60, and their connection to and cooperation with first and second housings 20, 30. As shown, follower 40 is shaped with an outer perimeter that includes an upper surface or edge 45, a lower surface or edge 46, and surface or edge having a notch 42 positioned between an upper projection 44 and lower projection 43. Follower 40 also optionally defines a channel 41 that extends between a first side surface 40*a* and a second side surface 40*b*. In a preferred embodiment, follower 40 also includes a spring connection structure 48. As shown in the Figures, first and second side surfaces 40*a*, 40*b* of follower 40 are approximately triangular, which is preferred. Alternatively, side surfaces 40*a*, 40*b* can approximate other shapes including, for example, a crescent, a quadrilateral, or all or part of circle or oval.

Follower 40 is preferably a solid component but can also be hollow or partially solid. Follower 40 also is sized to fit at least partly within the follower cavities 26, 36 formed by first and second housing 20, 30 such that follower 40 is hinged or is free to pivot about or relative to follower supports 28, 38. Where follower supports are pins or a shaft, they preferably are positioned within channel 41 formed by follower 40 so that follower 40 rotates about the supports 28, 38. Alternatively, where supports 28, 38 are connection points located on the inner surfaces 20*b*, 30*b* of housings 20, 30, then follower 40 may include protrusions, extensions, or an axle fixed to follower 40 or the like that rotatably fit into or connect to the connection points.

Notch 42 along the perimeter of follower 40 is preferably shaped and sized to accommodate the optimal movement desired when follower 40 pivots around supports 28, 38. Housing stoppers 23, 33 extend into notch 42, and lower projection 43 prevents excessive rotation in a first direction D1 as shown in FIG. 5. Upper projection 44 prevents excessive rotation in a second direction (not labelled) as shown in FIG. 10. Alternative cooperating structures can be used to prevent over rotation as will be understood by those skilled in the art.

Preferably, follower 40 rotates through the partly open first end of the magazine body housing formed by attached first ends 20*d*, 30*d* of first and second housings 20, 30 so that follower 40 is able to directly contact the firearm slide when practice magazine 10 is inserted in the magazine compartment of the firearm 12. Specifically, upper surface 45 of follower 40 is preferably configured to make contact with the bottom surface of a firearm's slide 14 when magazine 10 is inserted into firearm 12. Optionally, upper surface 45 includes at least a portion of substantially flat surface to facilitate cooperating with slide 14.

Spring 60 cooperates with follower 40 and first and second housings 20, 30 to bias follower 40 in first direction D1 as shown in FIG. 5. While a traditional compression spring is illustrated in the Figures, spring 60 should also be understood to include all types of springs and assemblies that act like springs including, for example, coil springs, tension springs, disc springs, wave springs, leaf springs, magnetic springs, spring cylinders, spring polymagnets, and pneumatic cylinders and pistons. FIG. 5 shows spring 60 as a compression spring positioned between follower lower surface 46 at spring connection structure 48 and first and second housings 20, 30 at spring supports 27, 37. In an alternative embodiment, a torsion spring can be substituted. The torsion spring would coil around one or both of follower supports 28, 38 and would connect to spring supports positioned accordingly on follower 40. Other alternatives to the compression spring include using pneumatic cylinders and pistons or stacked rejecting magnets, also known as magnetic springs or spring polymagnets, to create tension or compression forces. Any tension or compression method, apparatus, or assembly can be substituted as long as follower 40 is biased to exert force against the slide of the firearm when the practice magazine is inserted in the firearm.

When using the practice magazine with a firearm, it operates much like a real magazine loaded with ammunition due to weights 50 and spring-loaded follower 40. As the magazine is inserted into the firearm, the upper surface 45 of follower 40 contacts the bottom of the firearm's slide 14. The slide 14 then applies resistance or pressure downward on follower 40, which causes spring 60 to compress, as shown in FIG. 10. Likewise, where a different type of spring is used or a different method of creating a resistance force, when follower 40 is pressed against slide 14, the resistance force created by the torsion spring, magnets, or pneumatic piston increases. The resistance simulates the feel of inserting a loaded magazine into a firearm. Once fully inserted, the resistance force is maintained when the magazine catch notch 21 meets the magazine catch 16 of firearm 12 causing practice magazine 10 to lock into place. The magazine catch 16 also prevents practice magazine 10 from rattling in the grip of the firearm. Once practice magazine 10 is locked in place, firearm 12 feels like a loaded firearm. Practice magazine 10 therefore allows one to practice repeatedly ejecting and loading practice it under realistic conditions.

When ready to eject practice magazine 10 from firearm 12, the magazine catch 16 is externally activated and releases from magazine catch notch 21. Magazine 10 then ejects from the grip of the firearm with force created by the compressed spring 60 on follower 40 and slide 14 of firearm 12. Because it ejects due to the force of the spring on the follower and slide, magazine 10 ejects much like a real magazine ejects from a firearm, which therefore creates a more realistic experience for the practicing shooter.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

I claim:

1. A practice magazine for use with training firearms and fully-functioning firearms that have an empty magazine compartment, wherein the practice magazine comprises:

a) a body housing defining a weight cavity, a follower cavity, and a follower support;

b) a weight disposed in the weight cavity of the body housing;

c) a follower disposed at least partly in the follower cavity of the body housing and pivotally connected to the follower support; and d) a spring disposed in the follower cavity and positioned to cooperate with the follower such that the spring biases the follower in a first direction.

2. The practice magazine of claim 1 further comprising a magazine catch notch disposed on the body housing and configured to cooperate with a magazine catch on the firearm.

3. The practice magazine of claim 1 wherein the spring comprises a compression spring.

4. The practice magazine of claim 1 wherein the spring comprises a torsion spring.

5. The practice magazine of claim 1 wherein the spring comprises a magnetic spring.

6. The practice magazine of claim 1 wherein the spring comprises a pneumatic cylinder.

7. The practice magazine of claim 1 wherein the body housing defines a plurality of weight cavities and wherein the practice magazine further comprises a plurality of weights disposed in the weight cavities.

8. The practice magazine of claim 1 wherein the body housing further defines a partially open end and a follower stopper near the first end wherein the follower stopper is configured to prevent over rotation of the follower.

9. The practice magazine of claim 8 wherein the follower defines a notch located along its perimeter, wherein the notch is configured to cooperate with the follower stopper defined by the body housing.

10. The practice magazine of claim 9 wherein the housing follower support comprises a shaft and wherein the follower further defines a channel through which the shaft extends.

11. The practice magazine of claim 9 wherein the body housing further defines a spring support configured to attach the spring to the body housing and wherein the follower further defines a spring connection structure configured to attach the spring to the follower.

12. A practice magazine for use with training firearms and fully-functioning firearms that have an empty magazine compartment, wherein the practice magazine comprises:

a) a body housing comprising a first housing and a second housing removably connected to the first housing, wherein the first and second housings, when attached together, define:

i) first and second ends;

ii) an opening at the first end;

iii) a weight cavity disposed between the first and second ends; and iv) a follower cavity positioned near the first end and in fluid communication with the first end;

b) a weight disposed in the weight cavity of the attached first and second housings;

c) a follower pivotally attached to the body housing in the follower cavity, wherein the follower is positioned such that it can rotate partly out of the first end opening; and d) a spring disposed in the follower cavity and positioned to cooperate with the follower such that the spring biases the follower in a first direction.

13. The practice magazine of claim 12 further comprising a magazine catch notch disposed on the body housing and configured to cooperate with a magazine catch on the firearm.

14. The practice magazine of claim 12 wherein the spring comprises a compression spring.

15. The practice magazine of claim 12 wherein the spring comprises a torsion spring.

16. The practice magazine of claim 12 wherein the body housing defines a plurality of weight cavities and wherein the practice magazine further comprises a plurality of weights disposed in the weight cavities.

17. The practice magazine of claim 12 wherein the body housing further comprises a follower stopper near the first end wherein the follower stopper is configured to prevent over rotation of the follower.

18. The practice magazine of claim 17 wherein the follower defines a notch located along its perimeter, wherein the notch is configured to cooperate with the follower stopper.

19. The practice magazine of claim 18 wherein the follower has a substantially triangular perimeter and wherein the follower pivotally connects near one of its corners to the body housing.

20. A practice magazine for use with training firearms and fully-functioning firearms that have an empty magazine compartment, wherein the practice magazine comprises:

a) a body housing comprising a first housing and a second housing removably connected to the first housing, wherein the first and second housings, when attached together, define:

i) first and second ends;

ii) an opening at the first end;

iii) first and second weight cavities disposed between the first and second ends;

iv) a follower cavity positioned near the first end and in fluid communication with the first end; and v) a follower stopper extending into the follower cavity;

b) a first weight disposed in the first weight cavity;

c) a second weight disposed in the second weight cavity d) a follower pivotally attached to the body housing in the follower cavity, wherein the follower has a substantially triangular perimeter with an upper edge, a lower edge, and a notched edge and wherein the follower is positioned such that its upper edge can rotate at least partly out of the first end opening and the notched edge cooperates with the follower stopper;

e) a compression spring disposed in the follower cavity and positioned to cooperate with the lower edge of the follower such that the spring biases the follower in a first direction; and f) a magazine catch notch disposed on the body housing and configured to cooperate with a magazine catch on the firearm.

* * * * *